US005823155A

United States Patent [19]

Burner

[11] Patent Number: 5,823,155

[45] Date of Patent: Oct. 20, 1998

[54] CONTROL CIRCUIT FOR AN INCANDESCENT ELEMENT

[75] Inventor: Erwin Burner, Adelberg, Germany

[73] Assignee: J. Eberspächer GmbH & Co., Esslingen, Germany

[21] Appl. No.: 875,324

[22] PCT Filed: Dec. 20, 1995

[86] PCT No.: PCT/EP95/05048

§ 371 Date: Jun. 16, 1997

§ 102(e) Date: Jun. 16, 1997

[87] PCT Pub. No.: WO96/19664

PCT Pub. Date: Jun. 27, 1996

[30] Foreign Application Priority Data

Dec. 22, 1994 [DE] Germany ..... 44 46 113.5

[51] Int. Cl.[6] ..... F02B 9/08

[52] U.S. Cl. ..... 123/145 A

[58] Field of Search ..... 123/145 A, 179 BG; 364/431.1; 74/7 E

[56] References Cited

U.S. PATENT DOCUMENTS

| | | | |
|---|---|---|---|
| 4,594,975 | 6/1986 | Shigenobu | 123/145 A |
| 4,606,306 | 8/1986 | Caron et al. | 123/145 A |
| 4,658,772 | 4/1987 | Auth et al. | 123/145 A |
| 4,669,430 | 6/1987 | Reinold et al. | 123/179 BG |
| 4,862,370 | 8/1989 | Arnold et al. | 364/431.1 |
| 5,144,922 | 9/1992 | Kong | 123/145 A |
| 5,307,701 | 5/1994 | Thonnard | 74/7 E |
| 5,367,994 | 11/1994 | Hinkle | 123/145 A |
| 5,570,666 | 11/1996 | Rymut et al. | 123/145 A |

*Primary Examiner*—Raymond A. Nelli
*Attorney, Agent, or Firm*—McGlew And Tuttle

[57] ABSTRACT

A glow pin control circuit for controlling the electrical heating energy of a glow pin, in particular for auxiliary heating apparatus in vehicles. The control circuit including a switch that alternatingly turns on and off the supply voltage in modulated and clocked manner and is situated between the supply voltage terminal (V+) on the high potential side. The glow pin (G) may be designed without a regulating filament.

20 Claims, 2 Drawing Sheets

CONTROL CIRCUIT FOR AN INCANDESCENT ELEMENT

FIELD OF THE INVENTION

The invention relates to a glow pin control circuit for controlling the electrical heating energy of a glow pin that may be used for igniting fuel, in particular for auxiliary heating apparatus in vehicles, the control circuit comprising a direct voltage source delivering the heating energy and having a supply voltage terminal on the high potential side and a ground terminal on the low potential side, and a switch means that is connected in series with the glow pin between the supply voltage terminal and the ground terminal and alternatingly turns on and off the supply voltage supplied to the glow pin, in a modulated and clocked manner.

BACKGROUND OF THE INVENTION

Glow pins of auxiliary heating apparatus of vehicles are usually controlled in clocked manner with the aid of relays. Due to the inertia of the relay contacts, such clocked control can only take place with very low frequency, usually with a clock frequency of about 1 Hz. With such a low relay switching frequency, temperature fluctuations of the glow pin result, since the glow pin cools down during switching off periods. These temperature fluctuations cannot be prevented by supplying pulse width modulated switching control pulses to the relay. Such pulse width modulated switching control pulses in fact may be used for compensating voltage fluctuations of the direct voltage source delivering the heating energy, which as a rule is the vehicle battery, but the voltage value thereof may change depending on the load condition. However, the switching-off periods occurring when the switching relay is controlled with a pulse frequency of 1 Hz, are too long for being overcome by the temperature inertia of the glow pin.

It would thus be desirable to use switching control pulses of considerably higher frequency, for example in the range of 50 Hz. With such high switching control pulses the temperature inertia of the glow pin bridges the switching-off periods so that temperature fluctuations due to the clocked control of the glow pin do not occur any more. Such high switching frequencies, however, cannot be realized with relays due to the mechanical inertia of the relay contacts.

Moreover, relays are opposed to the trend of integrating control apparatus for auxiliary heating apparatus in vehicles in the heating apparatus housings. Relays thus constitute a hindrance with such integrated control apparatus.

SUMMARY AND OBJECTS OF THE INVENTION

It is an object of the invention to make available a glow pin control circuit of the type indicated at the beginning, which is suited better for integrated control apparatus and results in an as constant as possible glow temperature of a glow pin and an as high as possible safety of the glow pin operation.

A glow pin control circuit of the type indicated at the outset is improved according to the invention in that the switch means is composed with a semiconductor power switch connected between the supply voltage terminal on the high potential side and the glow pin. The semiconductor power switch selectively connects and disconnects the supply voltage to the glow pin or incandescent means in accordance with a switching control signal. A pulse modulation circuit or means is provided feeding a control terminal of the semiconductor power switch with switching control pulses forming the switching control signal. The pulses are of such high pulse frequency and are modulated in accordance with the currently present voltage value or magnitude of the direct voltage source in such manner that the glow temperature of the glow pin remains substantially constant, irrespective of fluctuations of the currently present voltage value of the direct current source and despite the switching-off periods due to the clocked operation.

The use of a semiconductor power switch instead of the relay common so far, on the one hand, leads to smaller space requirements of the glow pin control circuit, which more easily permits the integration of control apparatus, and in addition thereto allows operation with almost arbitrarily high switching control pulse frequencies, so that no cooling down of the glow pin takes place during the switching-off periods of the clocked supply voltage. The glow pin control circuit according to the invention thus does not only avoid temperature fluctuations caused by supply voltage fluctuations, but also temperature fluctuations caused by the clocked switching on and off of the supply voltage fed to the glow pin. The glow pin control circuit according to the invention thus achieves a high constancy of the glow temperature.

Another important aspect in terms of safety consists in the arrangement of the switch means between the supply voltage terminal on the high potential side and the glow pin. In case of an erroneous ground contact of the glow pin, the glow pin may be switched to a currentless state by the switch means, and thus may be turned off. If, in contrast thereto, the switch means is arranged between the glow pin and the ground terminal, the switch means, in case of ground contact of the glow pin, is bridged by this ground contact, and the glow pin cannot be switched to the currentless state.

In a particularly preferred embodiment, the glow pin is clocked with a switching control pulse frequency of 50 Hz. Suitable types of pulse modulation are pulse width modulation, pulse frequency modulation, pulse amplitude modulation, and pulse phase modulation.

In a particularly preferred embodiment, the pulse modulation circuit comprises a microcontroller wherein, by means of an algorithm stored in the microcontroller or a table stored in the microcontroller, a degree of modulation or modulation factor of the switching control pulses that leads to the constant heating energy is associated with the particular, currently present voltage value of the direct voltage source.

The currently present voltage value of the direct voltage source may be determined, for example, by means of a voltage divider that has applied thereto the currently present voltage, value of the direct voltage source or a voltage value proportional thereto and the partial voltage of which is fed to the pulse modulation circuit as a modulating signal.

With a particularly preferred embodiment, the semiconductor power switch has an overload protection circuit associated therewith. The latter my have an error reporting output terminal-that is connected to the pulse modulation circuit and, upon occurrence of overloading of the semiconductor power switch, in particular in the form of a too high power dissipation, delivers to the pulse modulation circuit an error signal resulting either in an alteration of the degree of pulse modulation towards lowering of the load of the semiconductor switch or complete switching off of the semiconductor power switch.

Due to the arrangement of the semiconductor power switch between the supply voltage terminal on the high potential side and the glow pin, the control terminal of the semiconductor power switch needs an increased driving voltage that is higher by about the sum of the supply voltage and the forward voltage of the semiconductor power switch than the driving voltage that would be fed to the control terminal of the semiconductor power switch if the semiconductor power switch were connected between the glow pin and the ground terminal.

This increased driving voltage is fed to the control terminal of the semiconductor power switch either in that it is fed from a supply voltage source of its own having a correspondingly high voltage value, or in that a voltage increasing circuit, also referred to as charging pump, is connected between the supply voltage source feeding the glow pin and the control terminal of the semiconductor power switch, for effecting the required increase in driving voltage.

Conventional glow pins are provided with a heating filament and a regulating filament connected in series therewith. The regulating filament involves a temperature-dependent alteration of its electrical resistance which is opposite to the temperature-dependent alteration of the electrical resistance of the heating filament. Fluctuations in the electrical heating energy supplied to the glow pin are counteracted by this regulating filament.

When pulse-modulated switching control pulses are used for clocking the semiconductor power switch for counteracting fluctuations of the supply direct voltage, the regulating filament can be dispensed with. It is thus possible to use less expensive glow pins. The compensation of supply voltage fluctuations by means of pulse modulation, however, is not opposed to the utilization of a regulating filament in the glow pin. Thus, no problem is involved in using conventional glow pins together with the glow pin control circuit according to the invention.

The use of an overload protection circuit with an error reporting output terminal provides the possibility of an error diagnosis and the self-protecting deactivation of the glow pin in case of ground contact, so that in turn cable fires can be avoided.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
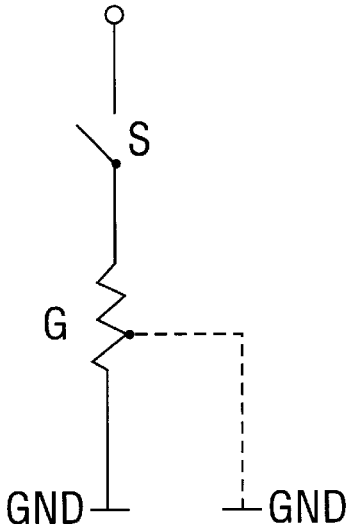
FIG. 1 is a basic circuit diagram of a glow pin control circuit according to the invention.

FIG. 1 is a basic circuit diagram of a glow pin control circuit according to the invention. The control circuit comprises a series connection of a glow pin or incandescent means G and a switch S. The series connection is located between the two poles V+ and GND of a supply voltage source. The switch S is situated between glow pin G and supply voltage terminal V+ on the high potential side.

In case a ground contact occurs at glow pin G, as indicated in FIG. 1 in broken lines, glow pin G can be switched to the-currentless state by opening of switch. Starting thereof, no more current flows and there is no longer a risk caused by an increased ground contact current.

Switch S symbolically represents a semiconductor power switch or means that is switched on and off in alternating manner by a switching control pulse source, not shown in FIG. 1. The average value of the clocked direct voltage V+ then becomes effective at glow pin G. This average value is dependent upon the pulse duty factor or duty cycle of the switching control pulses. By selection of the duty cycle, it is possible to change the effective direct voltage supplied to the glow pin G as heating energy.

The frequency of the switching control pulses closing and opening the switch in alternating manner is preferably selected to be in the range of 50 Hz. This frequency is so high that the switching-off periods, during which no heating energy is supplied to glow pin G, is not felt in a temperature fluctuation of the glow pin G due to the thermal inertia of the glow pin G. The glow temperature of the glow pin G thus is kept constant with high accuracy on the one hand by the modulation of the switching control pulses switching the switch S and on the other hand by the high frequency of these switching control pulses.

Figure 2:
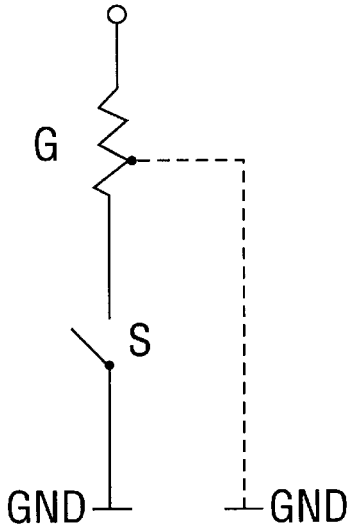
FIG. 2 is an example of a glow pin control circuit without ground contact protection, which is not in accordance with the invention.

FIG. 2 shows a glow pin control circuit in which, contrary to the teaching according to the invention, switch S is situated between the glow pin and the ground terminal of the direct voltage source. When a ground contact takes place in this case, as indicated in broken lines in FIG. 2 as well, such a ground contact bridges the switch S. The glow pin G cannot be switched to the currentless state then. Especially when switch S is controlled with switching control pulses, so that the effective heating power results from the duty cycle of the switching control pulses, such ground contact results in an increase of the effective heating power. The consequence thereof may be damage, for example cable fires or a defective glow pin.

Figure 3:
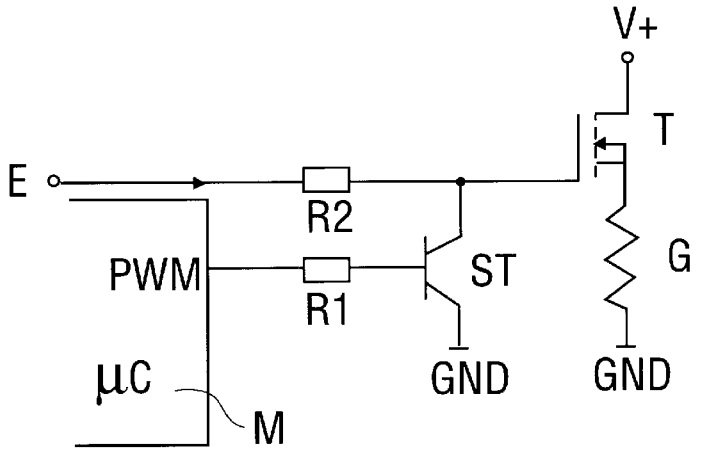
FIG. 3 is a glow pin control circuit according to the invention, including microcontroller control and overheating protection of the semiconductor power switch.

FIG. 3 shows a glow pin control circuit according to the invention in which the semiconductor power switch is constituted by a temperature-protected field effect transistor T. In accordance with the basic circuit diagram of FIG. 1, the latter is situated between glow pin G and supply voltage terminal V+ on the high potential side. Glow pin G is located between transistor T and the ground terminal. Transistor T preferably is constituted by a MOS-FET having an internal temperature protection circuit causing a counteracting or switching-off in case of an excessive temperature increase due to a too high power dissipation of transistor T. This embodiment of a glow pin control circuit according to the invention comprises a control transistor ST connected between a control electrode of switching transistor T and ground. In the embodiment shown, control transistor ST is constituted by a bipolar transistor having its collector connected to the gate of MOS-FET T, its emitter connected to ground and its base connected via a resistor R1 to a PWM signal output of a microcontroller M. The gate of transistor T is connected via a resistor R2 to an input E connected to an external voltage level increasing circuit (not shown) which is also referred to as a charging pump. By means of the charging pump, the potential present at input E is increased as compared to the potential that would have to be supplied to this input E if the semiconductor power switch according to FIG. 2 were connected between glow pin G and ground terminal GND. The increase required is approx. equal to the sum of the supply voltage V+ and the forward resistance of transistor T.

In case of the arrangement according to FIG. 2, the gate of the MOS-FET constituting switch S would have to be fed with a driving voltage equal to the gate-source voltage of the conducting MOS-FET, which is approx. 3 V with a practical embodiment of the MOSFET. In case of the arrangement according to the invention, as shown in FIG. 3, the gate of MOS-FET T is to be fed with a driving voltage of at least 15 V when one starts from a supply voltage V+ of 12 V and a forward voltage of MOS-FET T that is negligible with respect thereto.

Microcontroller M comprises an input (not shown) via which microcontroller M receives information on the particular, currently present voltage value of the direct voltage source. The microcontroller M either contains an algorithm or a table by means of which such a degree of modulation of the pulse width modulated signal delivered at output PWM is associated with each measured currently present voltage value of the direct voltage source, that glow pin G, irrespective of the particular currently present voltage value of the direct voltage source, always is fed with a constant effective direct voltage value and, thus, always with a constant heating power.

Figure 4:
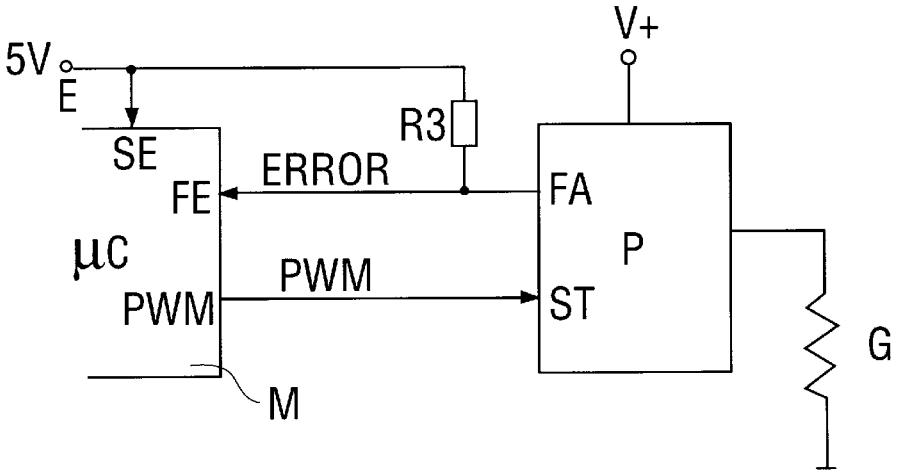
FIG. 4 is a glow pin control circuit according to the invention, involving microcontroller control and semiconductor power switch with overload protection and error reporting output.

FIG. 4 shows an embodiment in which the power switching transistor is part of a so-called PROFET P. This is a power transistor comprising an integrated overload protection circuit having an error reporting output terminal FA connected to an error signal input terminal FE of a microcontroller M. As in case of FIG. 3, microcontroller M comprises a PWM output via which pulse width modulated switching signals are supplied to PROFERT P via a control input ST. Error output FA furthermore is connected via a resistor R3 to a supply voltage terminal E fed with a supply voltage. The latter is fed in addition to a voltage detection input SE of microcontroller M. As in case of FIG. 3, microcontroller M produces a degree of modulation corresponding to the current supply voltage value for the PWM signal supplied to PROFERT P.

In the example shown in FIG. 4, a charging pump is integrated in PROFET P.

The mode of operation of the embodiment shown in FIG. 4 is as follows: In accordance with the currently present supply voltage value supplied to the voltage detection input SE of microcontroller M, microcontroller M selects a degree of modulation for the PWM signal fed to PROFET P. This degree of modulation of the PWM signal produces in PROFERT P an activation and deactivation of the connection between the supply voltage terminal V+ on the high potential side and glow pin G, which leads to the desired heating power of glow pin G. When the protective circuit contained in PROFET P determines an overload condition, this is reported via terminals FA and FE to microcontroller M which then either reduces the duty cycle of the semiconductor power switch contained in PROFERT P via an alteration of the degree of modulation of the PWM signal, or even opens this semiconductor power switch permanently or constantly so that glow pin G conducts no current.

Figure 5:
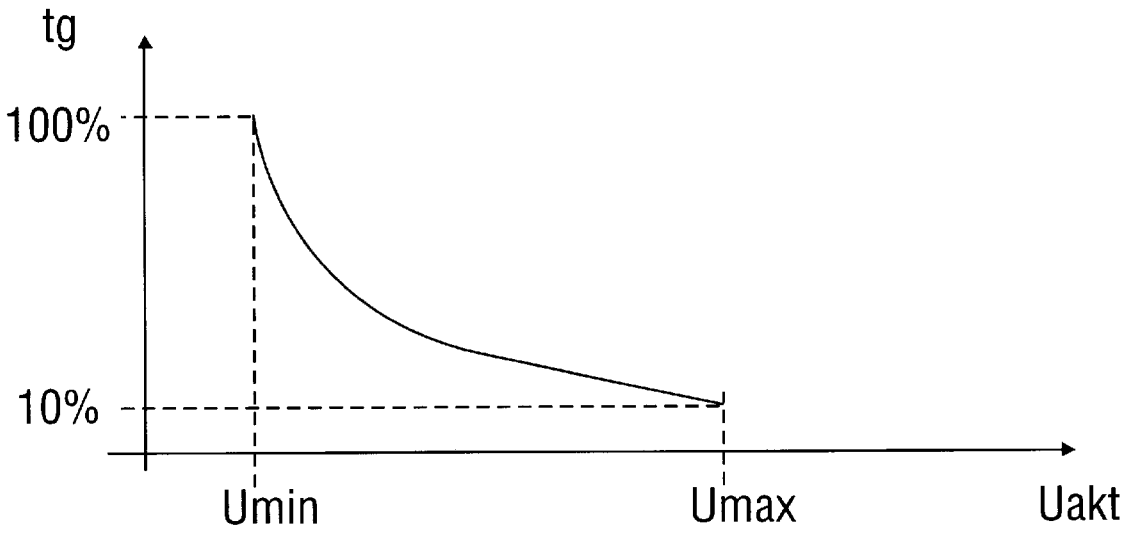
FIG. 5 is a characteristic curve for constant heating power of the glow pin.

FIG. 5 shows a characteristic curve of the dependency of the duty cycle tg upon the respective currently present supply voltage $U_{akt}$. The lower the particular currently present voltage $U_{akt}$ is, the higher is the duty cycle tg. And the higher $U_{akt}$ is, the lower is the duty cycle tg. In the example shown in FIG. 5, a minimum voltage $U_{min}$ and a maximum voltage $U_{max}$ of the supply voltage source are presupposed, which in practical application are not exceeded in downward direction and upward direction, respectively. The minimum currently present voltage in this example has a duty cycle of 100% associated therewith, whereas the maximum currently present voltage has a duty cycle of 10% associated therewith.

The duty cycle of the PWM signal for constant thermal power can be calculated on the basis of the following formula:

$$tg=(U^2_{eff}/U^2_{cur})*k_{GS}$$

wherein tg=duty cycle of the switching control pulses $U_{eff}$=effective direct voltage at glow pin (glow pin parameter)

$U_{cur}$=voltage currently present at glow pin $K_{GS}$=correction factor for compensating control losses (for example, tolerances, rise times in PROFERT P, contact transition resistances).

The glow pin control circuit according to the invention provides the following advantages:

power control of the glow pin depending on the particular supply voltage present;

lesser requirement of space by use of a semiconductor power component;

deactivation of the glow pin in case of ground contact;

in case of use of "intelligent" semiconductor components, for example a PROFET, an error diagnosis and thus a self-protecting glow pin control circuit are possible, which contributes in avoiding cable fires;

use of glow pins without regulating filament.

While specific embodiments of the invention have been shown and described in detail to illustrate the application of the principles of the invention, it will be understood that the invention may be embodied otherwise without departing from such principles.

I claim:

1. An ignition device for igniting fuel in a heating apparatus, the ignition device comprising:

a glow pin without a regulating filament;

direct voltage source means for providing heating energy, said direct voltage source means having a supply voltage terminal with a high potential and a ground terminal with a low potential;

switching means connected in series with said glow pin between said supply voltage terminal and said ground terminal of said direct voltage source means, said switching means alternatingly turning on and off said heating energy to said glow pin in a modulated and clocked manner, said switching means includes a semiconductor power switch connected between said supply voltage terminal and said glow pin, said semiconductor power switch including a control terminal;

pulse modulation means for measuring an actual voltage of said voltage source and for feeding said control terminal of said semiconductor power switch with switching control pulses having a high pulse frequency and modulated in accordance with fluctuations in said actual voltage of said direct voltage source in a manner to cause a glow temperature of said glow pin to remain substantially constant irrespective of said fluctuations of said actual voltage of said direct voltage source and despite switching-off periods of said clocked manner, said pulse modulation means includes a microcontroller using one of an algorithm stored in said microcontroller, and a table stored in said microcontroller, to associate said actual voltage of the direct voltage source with a degree of modulation of said switching control pulses to provide a substantially constant amount of heating energy to said low pin.

2. The ignition device of claim 1, wherein:

said pulse modulation means pulse width modulates said switching control pulses.

3. The ignition device of claim 1, wherein:

said pulse modulation means frequency modulates said switching control pulses.

4. The ignition device of claim 1, wherein:

said pulse modulation means pulse amplitude modulates said switching control pulses.

5. The ignition device of claim 1, wherein:

said pulse modulation means pulse phase modulates said switching control pulses.

6. The ignition device of claim 1, wherein:

said voltage of said direct voltage source is measured by means of a voltage divider that has applied thereto, one of said actual voltage of said direct voltage source, and a voltage value proportional thereto, a partial voltage of said voltage divider is supplied to said pulse modulation means as a modulating signal.

7. The ignition device of claim 1, wherein:

said semiconductor power switch includes an overload protection circuit.

8. The ignition device of claim 7, wherein:

said overload protection circuit includes an error reporting output terminal connected to said pulse modulation means, said overload protection circuit delivers to said pulse modulation means an error signal upon occurrence of overloading of said semiconductor power switch, said pulse modulation means performs one of an alteration of a degree of pulse modulation to cause a reduction of a load of said semiconductor power switch, and a complete deactivation of said semiconductor power switch.

9. The ignition device of claim 8, wherein:

said overload protection circuit delivers said error signal upon occurrence of overloading of said semiconductor power switch in a form of a too high power dissipation.

10. The ignition device of claim 1, wherein:

a voltage level increasing circuit is connected between said direct voltage source and said switching means to drive said control terminal of the semiconductor power switch with a driving voltage that is higher by approximately a sum of said supply voltage and a forward voltage of said semiconductor power switch.

11. The ignition device of claim 10, wherein:

said driving voltage is higher than a driving voltage that would be required at said control terminal of said semiconductor power switch if said semiconductor power switch were connected between said glow pin and said ground terminal.

12. The ignition device of claim 1, wherein:

said switching control pulses supplied to said switch means have a pulse frequency of approximately 50 Hz.

13. A device in accordance with claim 1, wherein:

said microcontroller executes said algorithm, and said algorithm is $$tg=(U^2_{eff}/U^2_{cur})*k_{GS}$$

wherein tg=said specific duty cycle $U_{eff}$=effective or rated direct voltage at said incandescent means (glow pin parameter)

$U_{cur}$=said measured actual voltage $K_{GS}$=correction factor for compensating control losses.

14. An ignition control device comprising:

an incandescent means for igniting fuel through incandescence;

semiconductor power switch means electrically connected to said incandescent means, said semiconductor power switch means being electrically connectable to a supply voltage, said semiconductor power switch means selectively electrically connecting and disconnecting the supply voltage to said incandescent means in accordance with a switching control signal;

pulse modulation means for generating said switching control signal with a plurality of pulses, said pulse modulation means measures said supply voltage, said pulse modulation means converts said measured supply voltage into a specific duty cycle of said pulses of said control signal by one of executing an algorithm based on said measured supply voltage and by consulting a lookup table based on said measured value stored in said pulse modulation means in order to maintain a temperature of said incandescent means substantially constant.

15. A device in accordance with claim 14, wherein:

said incandescent means ignites the fuel without a regulating element;

the supply voltage is a direct voltage source.

16. A device in accordance with claim 14, wherein:

said pulse modulation means modulates said plurality of pulses at frequency high enough to have a thermal inertia of said incandescent means maintain said temperature substantially constant between said plurality of pulses.

17. A device in accordance with claim 14, wherein:

said pulse width modulator includes a microprocessor means for said one of executing said algorithm and consulting said lookup table, said lookup table being stored in said microprocessor.

18. A device in accordance with claim 17, wherein:

said microprocessor executes said algorithm, and said algorithm is $$tg=(U^2_{eff}/U^2_{cur})*k_{GS}$$

wherein tg=said specific duty cycle $U_{eff}$=effective or rated direct voltage at said incandescent means (glow pin parameter)

$U_{cur}$=said measured supply voltage $K_{GS}$=correction factor for compensating control losses.

19. The ignition device of claim 14, wherein:

said switching means includes a temperature protected metal oxide field effect switching transistor in series between said supply voltage and said incandescent means, said semiconductor power switch means includes a bipolar control transistor connected between a control electrode of said switching transistor and ground, said modulated switching control signal being received by a base of said control transistor;

a voltage level increasing circuit is connected between said supply voltage and said control terminal of said switching transistor to drive said switching transistor with a driving voltage that is higher by approximately a sum of said supply voltage and a forward voltage of said switching transistor.

20. A device in accordance with claim 17, wherein:

said microprocessor consults said lookup table.

* * * * *